US008863458B2

(12) United States Patent
Noonan et al.

(10) Patent No.: US 8,863,458 B2
(45) Date of Patent: Oct. 21, 2014

(54) INSULATIVE SEALING SYSTEM AND MATERIALS THEREFOR

(75) Inventors: Patrick M. Noonan, Columbus, IN (US); Jeffrey R. Brisley, Carmel, IN (US)

(73) Assignee: Knauf Insulation GmbH, Shelbyville, IN (US)

( * ) Notice: Subject to any disclaimer, the term of this patent is extended or adjusted under 35 U.S.C. 154(b) by 0 days.

(21) Appl. No.: 13/816,127

(22) PCT Filed: Aug. 10, 2011

(86) PCT No.: PCT/US2011/047209

§ 371 (c)(1), (2), (4) Date: Feb. 8, 2013

(87) PCT Pub. No.: WO2012/021590

PCT Pub. Date: Feb. 16, 2012

(65) Prior Publication Data

US 2013/0133279 A1 May 30, 2013

Related U.S. Application Data

(60) Provisional application No. 61/373,774, filed on Aug. 13, 2010.

(51) Int. Cl.
*E04B 1/682* (2006.01)
*E04B 1/76* (2006.01)

(52) U.S. Cl.
CPC ..... *E04B 1/7604* (2013.01)
USPC ..... 52/407.3; 52/741.4; 52/742.13

(58) Field of Classification Search
CPC ... E04B 1/7604; E04B 1/7608; E04B 1/7658; E04B 1/7662; E04B 2001/742; E04F 21/085
USPC ..... 52/309.3, 407.3, 741.4, 742.13
See application file for complete search history.

(56) References Cited

U.S. PATENT DOCUMENTS

| | | | | | |
|---|---|---|---|---|---|
| 3,641,724 | A | * | 2/1972 | Palmer | 52/793.11 |
| 4,241,553 | A | * | 12/1980 | Reicherts et al. | 52/309.5 |
| 4,244,901 | A | * | 1/1981 | Wencley et al. | 264/46.4 |
| 4,471,591 | A | * | 9/1984 | Jamison | 52/309.9 |
| 4,914,883 | A | * | 4/1990 | Wencley | 52/309.5 |
| 5,389,167 | A | * | 2/1995 | Sperber | 156/71 |
| 5,425,908 | A | * | 6/1995 | Merser | 264/46.4 |

(Continued)

FOREIGN PATENT DOCUMENTS

| | | | |
|---|---|---|---|
| CA | 2 454 923 | * | 7/2004 |
| WO | WO 2005/007984 A1 | * | 1/2005 |
| WO | WO 2011/084256 A1 | * | 7/2011 |

OTHER PUBLICATIONS

PCT Search Report and Written Opinion for PCT/US2011/047209, completed Jan. 17, 2012.

*Primary Examiner* — Robert Canfield
(74) *Attorney, Agent, or Firm* — Knauf Insulation GmbH; James K. Blodgett

(57) ABSTRACT

This disclosure relates to an insulative system and materials therefor comprising a polymeric composition disposed at the junctions of the framing and exterior sheathing. In particular, an insulative system and materials therefor comprising a polymeric composition in the form of a sealing structure in contact with both the framing and exterior sheathing of a building are described.

37 Claims, 5 Drawing Sheets

(56) References Cited

U.S. PATENT DOCUMENTS

| | | | | |
|---|---|---|---|---|
| 5,666,780 | A * | 9/1997 | Romes et al. | 52/742.13 |
| 5,765,330 | A * | 6/1998 | Richard | 52/309.13 |
| 5,890,327 | A * | 4/1999 | Merser et al. | 52/91.3 |
| 6,283,221 | B2 * | 9/2001 | Hurray et al. | 169/30 |
| 6,651,402 | B2 * | 11/2003 | Grunst | 52/741.4 |
| 7,866,105 | B2 * | 1/2011 | Babbitt et al. | 52/404.1 |
| 8,399,062 | B2 * | 3/2013 | Romes et al. | 427/384 |
| 2004/0040241 | A1 * | 3/2004 | Grunst | 52/309.11 |
| 2006/0272280 | A1 * | 12/2006 | Romes et al. | 52/794.1 |
| 2009/0234072 | A1 | 9/2009 | Nakagawa | |
| 2011/0138724 | A1 * | 6/2011 | Olang | 52/309.4 |
| 2012/0037296 | A1 * | 2/2012 | Cai | 156/71 |
| 2013/0067841 | A1 * | 3/2013 | Grieco et al. | 52/309.4 |
| 2013/0081346 | A1 * | 4/2013 | Kulprathipanja et al. | 52/483.1 |
| 2013/0104469 | A1 * | 5/2013 | Fay | 52/173.1 |

* cited by examiner

INSULATIVE SEALING SYSTEM AND MATERIALS THEREFOR

CROSS-REFERENCE TO RELATED APPLICATIONS

This application is a national stage entry under 35 USC §371(b) of International Application No. PCT/US2011/047209, filed Aug. 10, 2011, which claims priority under 35 U.S.C. §119(e) to U.S. Provisional Application No. 61/373,774, filed 13 Aug. 2010, the disclosures of which are incorporated by reference herein.

TECHNICAL FIELD

This disclosure relates to an insulative system and materials therefor comprising a polymeric composition disposed at the junctions of the framing and exterior sheathing. In particular, an insulative system and materials therefor comprising a polymeric composition in the form of a sealing structure in contact with both the framing and exterior sheathing of a building are described.

BACKGROUND

Insulating structures such as buildings and homes is an important means of conserving resources both environmentally and economically. A common way to insulate buildings or homes is to install batts of fiberglass or blown fiberglass insulation around the exterior walls of the structure. To this end, fiberglass insulation materials are frequently and effectively used to insulate attics, crawl spaces, and vertical wall cavities. It is well established that such materials prevent heat from being transmitted across the insulated area regardless of whether the conditioned air was warmer or cooler than the external air. Specifically, in the construction and/or insulation of buildings, insulation is used between the interior wall and the external sheathing in the void defined by the framing material, the exterior sheathing, and the interior wall material (hereinafter called the "wall cavity"). The insulation can be placed between the framing members after installation of the exterior sheathing. For example, in residential construction an insulation batting may be installed between 2"×4" wall framing, an oriented strand board exterior sheathing, and a drywall interior. Also prevalent in residential construction is the use spray-in or loose fill insulation in this same manner.

The benefits of tightly sealing a building so as to prevent air infiltration have been widely recognized as an important goal both environmentally and economically. For example, the EPA has emphasized the adverse effects of air leaking through a building envelope that is not well sealed. The leakage of air decreases the comfort of a residence by allowing moisture, cold drafts, and unwanted noise to enter and may lower indoor air quality by allowing in dust and airborne pollutants. Furthermore, air leakage may account for between 25 percent and 40 percent of the energy used for heating and cooling in a typical residence. The EPA has determined that the amount of air leakage in a house depends on two factors. The first is the number and size of air leakage paths through the building envelope. Primary sources of these leakage paths are joints between building materials, gaps around doors and windows, and penetrations for piping, wiring, and ducts. The second factor is the difference in air pressure between the inside and outside. Pressure differences are caused by wind, indoor and outdoor temperature differences (stack effect), chimney and flue exhaust fans, equipment with exhaust fans (dryers, central vacuums) and ventilation fans (bath, kitchen).

The EPA has further stated that it is important to seal the building envelope during construction prior to installation of the drywall because once covered, many air leakage paths cannot be accessed and properly sealed. There are many products available for air sealing including caulks, foams, weatherstripping, gaskets, and door sweeps.

One technology that has been developed for the sealing of buildings is the use of spray-foam insulation. The application of spray-foam insulation to building structures has generally followed two divergent methodologies using a range of foam based materials. In one approach, a spray-foam insulation is applied to a building structure in a manner to completely fill the void (hereinafter referred to as "wall cavity") between the outer sheathing and the inner wall substrate between the structural supports (hereinafter referred to as wall studs). In this application, the spray foam insulation replaces the use of other insulation materials such as fiberglass insulation batts, blown-in fiberglass insulation, or loose-fill cellulosic insulation. The second approach is to use spray-foam insulation in the corners of the wall cavities combined with a traditional batt or loose fill fiber insulation.

The limitations of both of these techniques are apparent by an examination of the spray-foam material. Traditionally, the spray-foam material was a rigid polyurethane foam. The rigid polyurethane foams were formed on-site by mixing polyols with isocyanates which are very reactive. The isocyanates used were typically aromatic isocyanates, such as diphenylmethane diisocyanate (MDI) or toluene diisocyanate (TDI). To form a foam, the isocyanate component is combined with a polyol in the presence of a blowing agent and sprayed out of a nozzle onto the surface to be treated. One disadvantage is that the material is prone to crack or pull away from the surface being insulated either at the time of installation or upon aging. With cracks and gaps, the structure is susceptible to air infiltration.

There are several other limitations associated with the use of spray-foam insulation products. For example, they are typically derived from non-renewable chemical sources. The spray-foam process requires handling two highly reactive compounds that are mixed together in advanced proportioners using specialized foaming equipment. Not only is the installation equipment expensive, but it also requires advanced worker training and limits the environmental conditions under which the foam can be installed. The chemistry of making the foam requires a precise mix of the polyol and the isocyanate for the foam to have the prescribed properties; thus, operator or equipment error can easily result in the manufacture of sub-optimal foam. Finally, the installation of spray-foam results in the release of substantial volatile organic compounds and toxins. To protect workers from these chemicals, advanced personal protective equipment must be worn and the structure must be quarantined for a time sufficient for the vapors to dissipate. Dissipation of the vapors includes releasing the vapors into the environment where they are pollutants that contribute to the formation of smog.

SUMMARY OF THE INVENTION

According to the present disclosure, an insulative system is described including a framing system, an exterior sheathing, and an insulative material.

In illustrative embodiments, a building insulation system comprises a non-foamed elastomeric polymer and a low density fiber insulation product. The elastomeric polymer is adapted to contact a building to fill and seal gaps, the gaps formed at a location between two or more structural members of a wall.

DETAILED DESCRIPTION

While the invention is susceptible to various modifications and alternative forms, specific embodiments will herein be described in detail. It should be understood, however, that there is no intent to limit the invention to the particular forms described, but on the contrary, the intention is to cover all modifications, equivalents, and alternatives falling within the spirit and scope of the invention.

Figure 1:
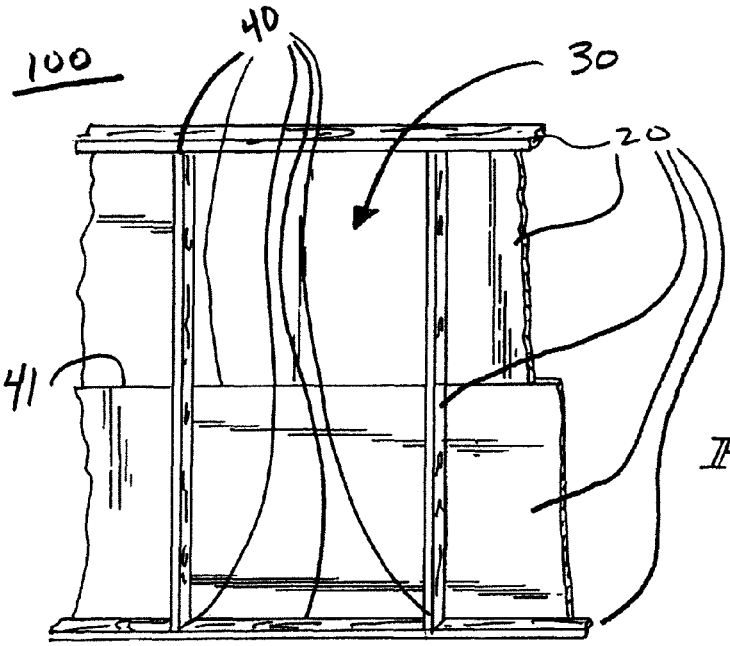
FIG. 1 is a perspective view of structural members arranged to create a wall having a cavity and showing location where the structural members contact each other.

Referring now to FIG. 1, shown is a perspective view of structural members 20 arranged to create a wall 100 having a cavity 30 and showing representative locations 40 where structural members 20 contact each other. Specifically, FIG. 1 shows an exemplary configuration for an exterior wall that includes the use of 2"×4" framing with 4'×8' exterior sheathing. In this representation, the sheathing is arranged to be attached to the framing in a manner so that their longer dimension is horizontally positioned. As such, a horizontal gap 41 is formed between the sheathings.

As used herein, the term sheathing describes those materials suitable for providing the exterior wall of structure, such as a building. For example, exterior sheathing is applied to the exterior of the stud wall before the exterior finish is attached. Examples of sheathings include blackjack, plywood, oriented strand board (OSB), fiberglass/resin panels, steel and aluminum panels. One skilled in the art would appreciate that many such wall configurations would include other components at various stages during construction. For example, the wall may also include pipes, ducts, wires, and/or receptacles. These additional components could be arranged within the wall in a manner that included creating holes in the structural members so that the components could pass through the wall. For example, wires may be run along the length of some structural members and then through a hole made in a structural member. Furthermore, one skilled in the art would appreciate that holes for these non-structural components will often result in gaps between the non-structural component and the structural component. As used herein, the term gap includes those gaps between structural members and between structural members and non-structural components.

Figure 2:
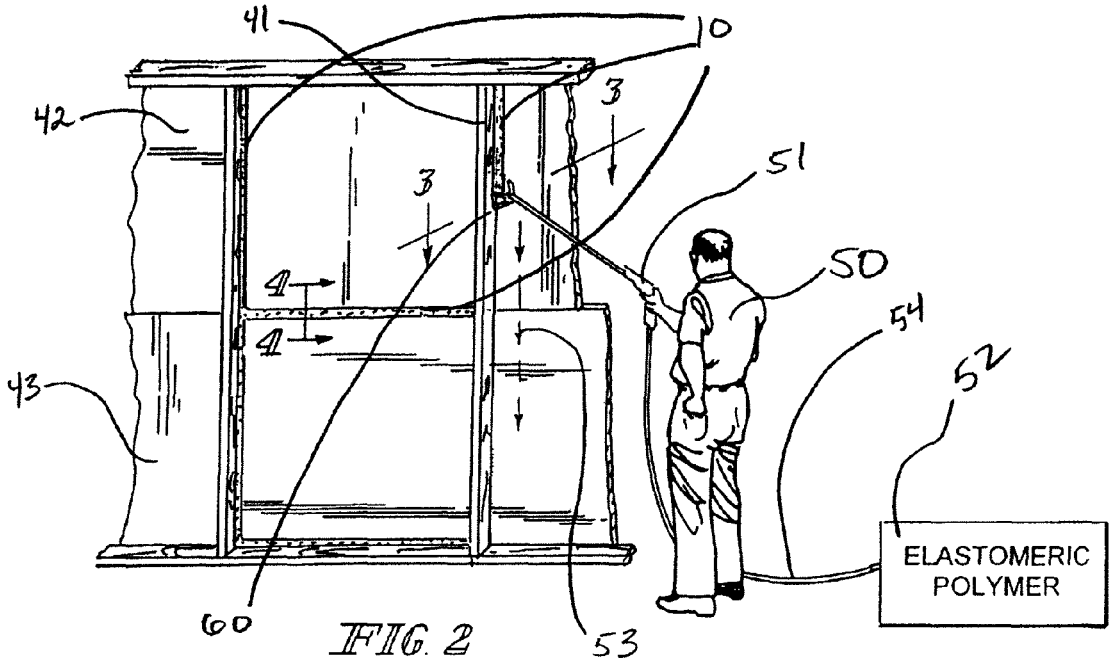
FIG. 2 is a perspective view similar to FIG. 1 showing a worker using a gun to apply an elastomeric material to the locations where the structural members contact each other by moving the gun in a direction across the structural members to fill and seal gaps.

Referring now to FIG. 2, shown is a perspective view similar to FIG. 1 showing a worker 50 using a gun 51 to apply an elastomeric material 10 from a single container reservoir 52 shown diagrammatically to locations 40 where structural members 20 contact each other. Worker 50 is shown moving gun 51 in a downwardly direction 53 across an exterior sheathing panel 42 along a framing member 41. Worker 50 can quickly move gun 51 across panel 42 because gun 50 includes a distance control mechanism 60 on the end of gun 51. Gun 51 dispenses elastomeric material 10 under pressure provided by a pumping device not shown. The pumping device provides sufficient pressure to move elastomeric material from a single reservoir through hose 54 into gun 51 so that elastomeric material 10 fills and seals gaps in wall 100.

Figure 3:
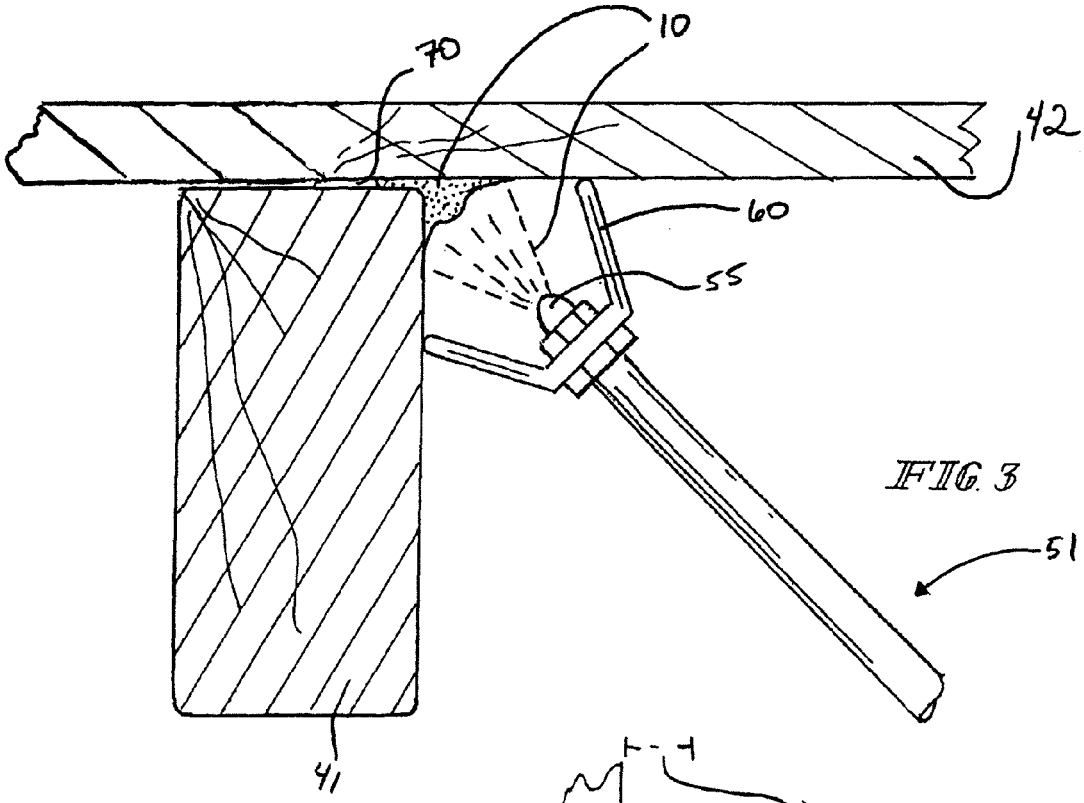
FIG. 3 is an enlarged sectional view taken along line 3-3 of FIG. 2 showing that the elastomeric material is sprayed towards the location where the structural members contact each other so that the elastomeric material partially fills the gaps between the structural members and forms a seal bridging from the first to the second structural member so that air can no longer infiltrate through the gap.

Referring now to FIG. 3, shown is an enlarged sectional view taken along line 3-3 of FIG. 2 showing that elastomeric material 10 is sprayed from gun 51 through a nozzle 55 towards a gap 70 where framing member 45 is in partial contact (not shown) with exterior sheathing 42. One skilled in the art will appreciate that sheathing 41 is attached to framing member 45 through the use of an nails or screws and that a over the entire range that the two are meant to be contacted, gaps will be present. The gaps may be of very limited size, especially in the vicinity of the screws or nails; however, the presence of these gaps will enable the transmission of air from one side of the gap to the other. Elastomeric material 10 leaves nozzle 55 and is distributed onto framing member 45 and sheathing 42 in a manner partially controlled by the shape of the aperture in nozzle 55 (not shown). Air-less paint sprayers are readily used in the spraying of the elastomeric material, thus aperture choices generally available for those devices may find application within the scope of the current disclosure. Specifically, nozzles having apertures ranging from 0.013 inches to 0.017 inches may typically be used. Elastomeric material 10 contacts both sheathing 42 and framing member 41 and is forced into gap 70.

Figure 4:
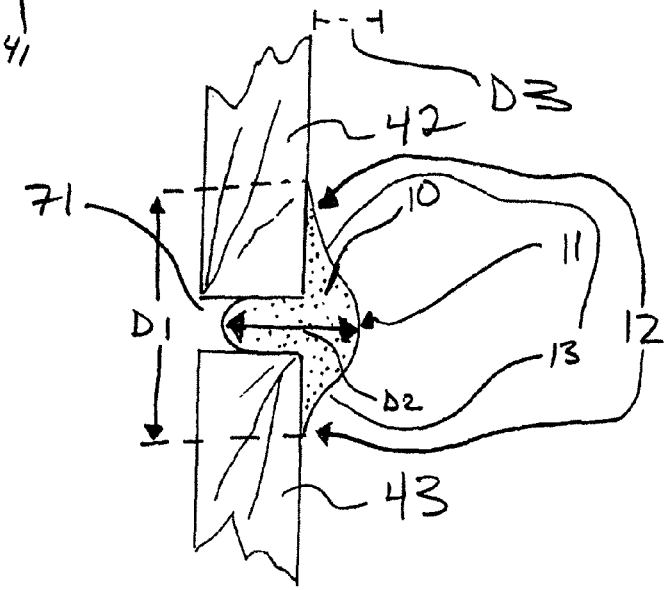
FIG. 4 is an enlarged sectional view taken along line 4-4 of FIG. 2 showing a similar view as FIG. 3 except that the two or more structural members were not contacting each other, but a gap was formed between two structural members that were located in close proximity to each other; further showing that the elastomeric material forms a bead having a cross-section characterized with a central maxima and a diminishing pattern that extends out for a distance onto each of the structural members and a portion of the cross-section is characterized as partly filling the gap between the two structural members.

Referring now to FIG. 4, shown is an enlarged sectional view taken along line 4-4 of FIG. 2 showing a similar view as FIG. 3 except that it shows a second gap 71 between sheathing 42 and a lower sheathing 43. As recommended by manufacturers' recommendations, a gap of ⅛ of an inch is purposefully left between sheathing 42 and sheathing 43 to accommodate the natural expansion of the wood. Elastomeric material 10 is shown having a cross-sectional profile that is referred to herein as a "plug" that includes central maxima 11 and a diminishing pattern extended outwardly from a central maximum 11 to include tail regions 12. Between tail regions 12 and central maximum 11 are intermediate regions 13 which are shown having a concave surface opposite the sheathing members. The plug extends into gap 71 and at least partially fills it. Included in FIG. 4 is a dimension D1 that represents the overall size of the plug laterally across the cross-sectional view. Dimension D2 represents the total thickness of elastomeric material 10 including the height dimension D3 of central maximum 11 and the depth in which elastomeric material 10 extends into gap 71.

Figure 5:
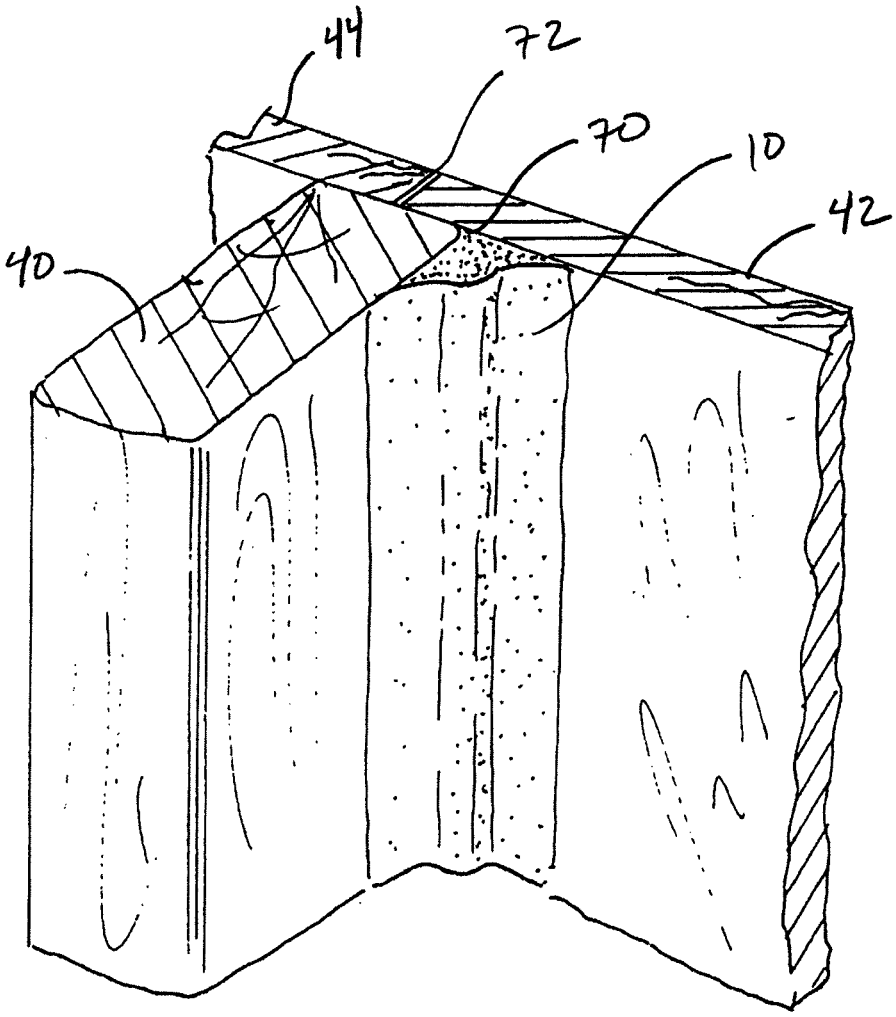
FIG. 5 is an enlarged perspective view similar to FIG. 1 showing that the bead is configured to have a relatively uniform cross-sectional area moving across or down a structural member so that the gap is uniformly filled and sealed across entire portions of the wall.

Referring now to FIG. 5, shown is a greatly enlarged perspective view similar to FIG. 1 showing that the manner in which the elastomeric material is applied to the structural members (here to the gaps between framing member 40, sheathing 42, and an additional sheet of sheathing 44) provides the plug with a relatively uniform shape moving across or down a structural member so that the gap is uniformly filled and sealed across entire portions of the wall. FIG. 5 shows an application of elastomeric material 10 in an alternative situation in which an additional gap 72 is in the proximity of framing member 40 so that elastomeric material 10 at least partially fills gaps 70 and 72.

Figure 6:
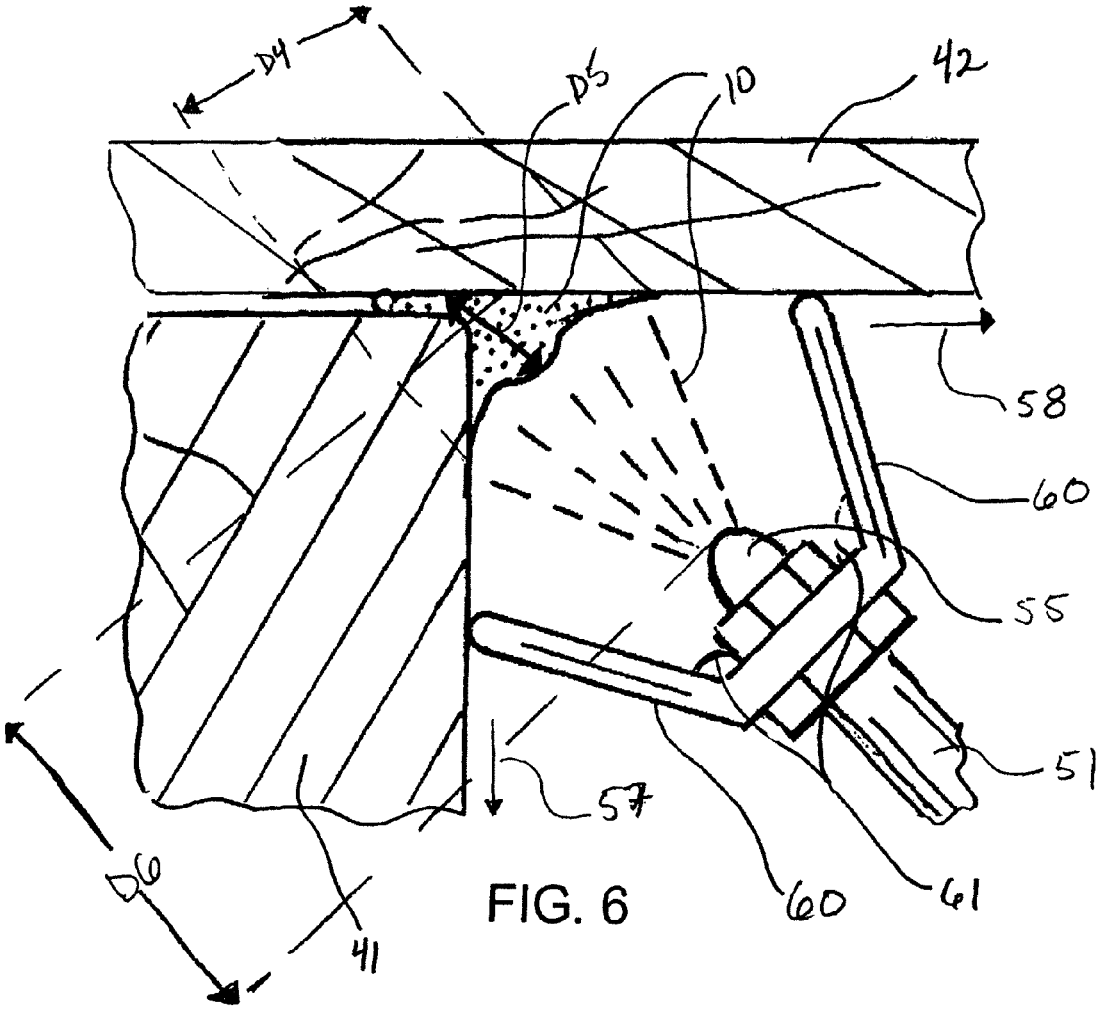
FIG. 6 is a greatly enlarged sectional view of FIG. 4 showing an end of the gun that includes a distance control mechanism in contact with the structural members such that the distance between the nozzle and the gap can be uniformly maintained while the gun is moved across the structural members that make up the wall.

Referring now to FIG. 6, shown is a greatly enlarged sectional view of FIG. 4. In particular, shown is a portion of gun 51 that includes distance control mechanism 60 in contact with framing member 41 and sheathing 42 so that distance D6 between nozzle 55 and gap 70 can be uniformly maintained while gun 51 is moved across the structural members that make up wall 100. Distance control mechanism 60 is attached to gun 51 in a manner, for example at an angle 61, such that a single distance control mechanism 60 is suitable for applying elastomeric material 10 to both right angled wall locations as shown in FIG. 6 or planar wall locations as shown in FIG. 4. One skilled in the art will appreciate that structural members 20 are often very dusty in the context of a building site. One aspect of the present disclosure is that the elastomeric material is projected from gun 51 at such a high velocity, dust on the surface of structural members 20 is rapidly removed by the air pressure preceding the stream of elastomeric resin 10. Accordingly, arrows 57 and 58 show the direction in which air and dust are removed from structural members in response to projecting elastomeric resin 10 at high velocity towards wall 100. Also shown in FIG. 6 is dimension D4 which is the width of the plug and dimension D5 which is the depth of the plug where elastomeric material is applied to a right angle portion of wall 100 as shown.

Figure 7:
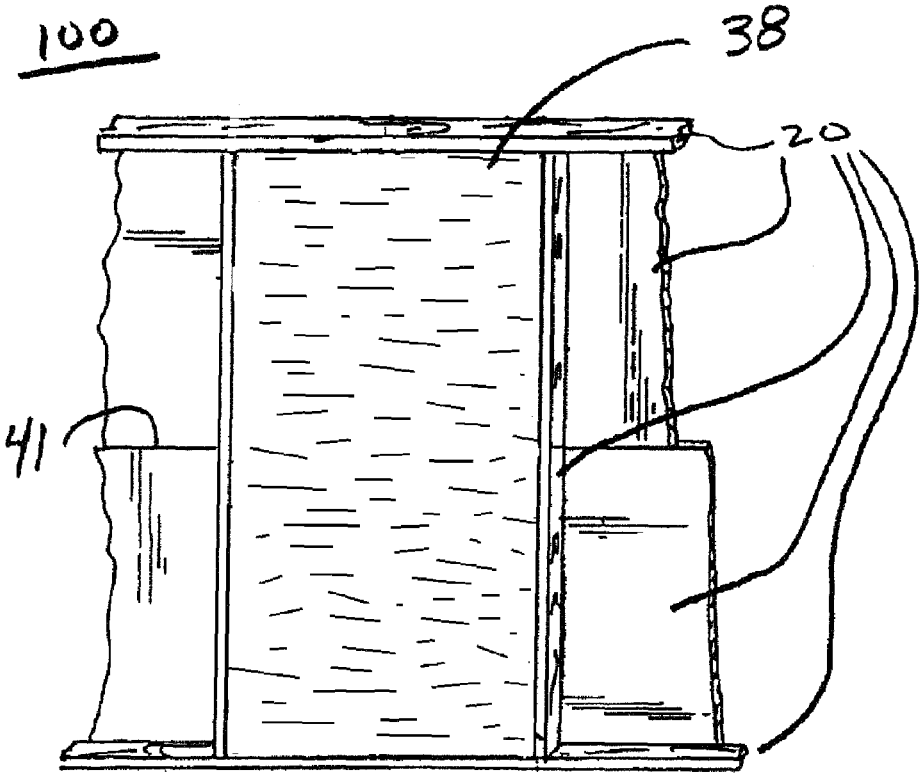
FIG. 7 is a perspective view similar to FIG. 1 showing a fiber insulation product installed in the cavity in the wall.

Referring now to FIG. 7, shown is a perspective view similar to FIG. 1 showing fiber insulation product 38 installed in cavity 30 (shown in FIG. 1) in wall 100.

A building insulation system of the present disclosure comprises an elastomeric polymer and a low density fiber insulation product. In illustrative embodiments, the elastomeric polymer is adapted to contact a building to fill and seal gaps, the gaps formed at a location between two or more structural members of a wall. In further illustrative embodiments, the elastomeric polymer configured to provide means for blocking movement of air through the wall so that air infiltration is diminished by at least about 96% to maximize energy efficiency of the structure, total volatile organic emissions released during curing is minimized, and ASTM E84 flame resistance is better than 25/75.

In one embodiment, the elastomeric polymer is configured to have a cross-sectional profile featuring a central ridge having a depth of between about 2 mm and 15 mm. Referring back to FIG. 4 and FIG. 6, dimensions D2 and D5 show the depth of a representative central ridge profile for a plug in a right angle configuration and a planar configuration. In one embodiment, the dimensions D2 and D5 are between about 4 mm and 12 mm. The shape of the front surface of the plug, the side that would be exposed to the incident spray takes what appears to be a form of Guassian distribution. This Guassian-type distribution is an indication that the elastomeric material is ejected from the nozzle at a sufficient velocity so that it is particularized into many small droplets. The droplets come into contact with a substrate according to a distribution in which the highest number of droplets and/or the largest droplets come into contact with the substrate in line with the aim of the nozzle.

This distribution is unexpected in light of the other known applications for the nozzle/gun/airless sprayer apparatus. Generally, this type of apparatus is used to evenly distribute paint across a surface without generating a central peak. To the sides of the central peak, as shown in FIG. 4, an intermediate area follows a diminishing pattern away from the central peak to the tail regions. As can be the case with various Guassian shapes, the rate of thickness change as one moves laterally from the central peak to the tail regions can vary according to several procedure variations. The tail regions are not truly Guassian in shape as the asymptotic diminution of a Gaussian is not accurately matched by the distribution of elastomeric material in that regions of the substrate outside the dimension D1 can effectively be considered devoid of any elastomeric material. However, the tail regions of the plug are characterized as having a high contact area to mass relationship. Accordingly, the amount of elastomeric material deposited in the tail regions provides a disproportionally great percentage of the adhesion to the substrate on a weight basis. Thus according to one aspect of the present disclosure, the plug profile disclosed herein provides for unexpected levels of adhesion over configurations known in the art. In one embodiment, the cross-sectional profile includes a tail region that extends onto the two or more structural members according to a diminishing pattern. In illustrative embodiments, the cross-sectional profile results in a concave surface facing away from the two or more structural members.

Dimensions D2 and D5 are limited in amplitude on the lower end of the thickness regime by the need to consistently fill and seal the gap properly. For example, the central peak is that area built-up from the incidence of elastomeric material on the substrate. In those situations where the central peak is below 2 mm, there is likely an insufficiency of elastomeric material to properly seal and fill the gaps. There may be excepts where tolerances are extremely low where this generalization is not accurate. The upper range is only limited in that a diminishing return, in terms of effectiveness sealing and filling, is expected as the amount of elastomeric material used is increased such that the central peak exceeds 15 mm. While situations certainly exists in which larger central peaks may be useful, those are within the general scope of the present disclosure.

In illustrative embodiments, the elastomeric polymer is configured to have a cross-sectional profile having an area of between about 16 $mm^2$ and 169 $mm^2$. While the cross-sectional area is irregular, an amount of elastomeric material that has been found to be effective within the scope of the present disclosure typically has cross-sectional area as stated herein. This represents a significant distinction between foam-based materials used in a similar manner. Specifically, foam-based material expands to volumes typically in the range of 3 to 10 times their original volume and have significantly increased cross-sectional areas. In one embodiment, the elastomeric polymer is configured to have a cross-sectional profile having an area of between about 36 $mm^2$ and 144 $mm^2$. In another embodiment, the elastomeric polymer is configured to have a cross-sectional profile having an area of between about 36 $mm^2$ and 100 $mm^2$.

While the thickness of the elastomeric material in the tail regions is diminishingly small, the importance of this region to adhesion to the substrate is disproportionally, by weight, important. In one embodiment of the present disclosure, the diminishing pattern extends onto one of the two or more structural members for a distance of between 5 mm and about 80 mm. In another embodiment, the diminishing pattern extends onto one of the two or more structural members for a distance of between 5 mm and about 45 mm. Another aspect of the cross-sectional profile important to adhesion to the substrate is that the elastomeric material at least partially fills the gap between the two or more structural members. Using the high-pressure application as described herein, the elastomeric material is forced into the gap to an extent heretofore not achieved for this type of material. Thus, in addition to the adhesion forces between the elastomeric material and the substrate maintaining the seal and fill of the gap, the physical entrapment of at least a portion of the plug within the gap provides a force that prevents the disbondment of the seal over time.

In illustrative embodiments, a method for insulating a wall comprises spraying a non-foaming elastomeric material onto gaps formed at a location between two or more structural members of a wall, the two or more structural members defining a wall cavity, waiting for an amount of time sufficient for the elastomeric material to cure, and installing a fiber insulation product into the wall cavity. In one embodiment, spraying includes pumping the elastomeric material from a single container to a dispensing gun. In another embodiment, spraying includes using an airless sprayer at an operating pressure of greater than about 100 psi. In another embodiment, spraying includes using an airless sprayer at an operating pressure of between about 500 and about 4000 psi. In yet another embodiment, spraying includes using an airless sprayer at an operating pressure of between about 1500 and about 3000 psi. In yet another embodiment, spraying includes using a gun having a distance control mechanism and a nozzle for spraying the elastomeric material, the distance control mechanism maintaining a distance between the nozzle and the one or more structural members.

In illustrative embodiments, spraying includes contacting the distance control mechanism with the one or more structural member and moving the gun across the structural member so that the distance between the structural member and the nozzle remains substantially uniform. In one embodiment, spraying includes dispensing an amount of elastomeric material at a predetermined rate and moving the gun across the structural member includes moving with a substantially constant speed so that the amount of elastomeric resin dispensed onto the gap remains substantially uniform across the structural member. In another embodiment, spraying includes forming a bead having a cross-sectional profile comprising a central maximum with diminishing edges. In yet another embodiment, spraying includes projecting the elastomeric material with sufficient pressure so that the elastomeric material at least partially fills the gap between the structural members. In another embodiment, the substantially constant speed is in the range of about 0.3 to about 2 feet per second.

One aspect of the present disclosure is that the elastomeric material utilized has novel properties over those known in the prior art. Those novel properties are delivered through a composition heretofore unavailable. The composition is derivable from a commercially available duct sealer. The duct sealer was modified generally by adjusting the ratios of resin to filler to obtain unexpected utility within the scope of the present disclosure. In one embodiment, the elastomeric polymer comprises by weight about 10% to about 60% of an carboxylic acid containing polymer, about 16% to about 60% of one or more inorganic fillers, and less than about 5% flame retardant. In another embodiment, the elastomeric polymer comprises, by weight, about 10% to about 40% of an acrylic resin, about 20% and 45% water, about 10% to about 30% calcium carbonate, about 5% to about 10% Kaolin clay, about 1% to about 5% titanium dioxide, and less than about 3% flame retardant. In another embodiment, the elastomeric polymer comprises a dipropylene glycol dibenzoate, a polyvinyl acetate emulsion, and a polymerized rosin. In another embodiment, the elastomeric polymer has a pH of between about 7.2 and about 10.3. In yet another embodiment, the elastomeric polymer has a pH of between about 8.4 and about 9.6.

One aspect of the present disclosure is that the elastomeric material was developed so that it releases extremely low total volatile organic content upon curing. In one embodiment, the total volatile organic emissions released during curing is less than about 0.5 mg/m$^3$. In another embodiment, the total volatile organic emissions released during curing is less than about 0.1 mg/m$^3$. In another embodiment, the total volatile organic emissions released during curing is between about 0.001 than about 0.01 mg/m$^3$. Further distinguishing the elastomeric material of the present disclosure from those foams known in the art, the elastomeric polymer, as described herein, has in illustrative embodiments, a cured density of between about 0.8 and about 1.8 g/mL. In one embodiment, the elastomeric polymer has a cured density of between about 1 and about 1.6 g/mL. In another embodiment, the elastomeric polymer has a cured density of between about 1 and about 1.3 g/mL.

A building insulation system of the present disclosure comprises an elastomeric polymer and a low density fiber insulation product. In one embodiment, the low density fiber insulation product is a mineral fiber insulation product. In another embodiment, the low density fiber insulation product is a fiberglass insulation product. In yet another embodiment, the low density fiber insulation product is a batt of fiberglass insulation. In another embodiment, the low density fiber insulation product is a loose fill or blown fiberglass insulation. In one embodiment, the low density fiber insulation product is a cellulosic loose fill or blown insulation product. In one embodiment, the low density fiber insulation product has a density from about 0.4 lbs/ft$^3$ to about 6 lbs/ft$^3$. In another embodiment, the low density fiber insulation product has a density from about 0.4 lbs/ft$^3$ to about 1.5 lbs/ft$^3$. In another embodiment, the low density fiber insulation product has a density from about 0.75 lbs/ft$^3$ to about 2.5 lbs/ft$^3$. In yet another embodiment, the low density fiber insulation product has a density from about 2.25 lbs/ft$^3$ to about 4.25 lbs/ft$^3$. In another embodiment, the low density fiber insulation product has a density from about 3.75 lbs/ft$^3$ to about 5.2 lbs/ft$^3$.

In illustrative embodiments, the low density fiber insulation product has a R-value of from about 11 to about 60. In one embodiment, the low density fiber insulation product has a R-value of from about 2 to about 8. In another embodiment, the low density fiber insulation product has a R-value of from about 3.4 to about 10.2. In yet another embodiment, the low density fiber insulation product has a R-value of from about 8 to about 38. In one embodiment, the low density fiber insulation product has a noise reduction coefficient of from about 0.5 to about 1.10. In another embodiment, the low density fiber insulation product has a noise reduction coefficient of from about 0.6 to about 0.70. In yet another embodiment, the low density fiber insulation product has a noise reduction coefficient of from about 0.7 to about 1.00. In yet another embodiment, the low density fiber insulation product has a noise reduction coefficient of from about 0.95 to about 1.15.

A building insulation system according to the present disclosure illustratively comprises a non-foamed elastomeric polymer and a low density fiber insulation product, wherein the elastomeric polymer is adapted to contact a building to fill and seal gaps, the gaps formed at a location between two or more structural members of a wall. In one embodiment, the elastomeric polymer is configured to have a time of ignition of greater than 60 seconds as determined according to UL 723. In another embodiment, the elastomeric polymer is configured with to have a time of ignition of between about 60 seconds and 360 seconds as determined according to UL 723. In another embodiment, the elastomeric polymer is configured with to have a time of ignition of between about 70 seconds and 140 seconds as determined according to UL 723.

In illustrative embodiments, an 8 foot by 10 foot wall tested according to ASTM E283/E331 has an air filtration of less than 1 standard cubic foot per minute at a manometric pressure of 0.1 inches of water. In one embodiment, an 8 foot by 10 foot wall tested according to ASTM E283/E331 has an air filtration of less than 1.5 standard cubic foot per minute at a manometric pressure of 0.2 inches of water. In another embodiment, an 8 foot by 10 foot wall tested according to ASTM E283/E331 has an air filtration of less than 2 standard cubic foot per minute at a manometric pressure of 0.3 inches of water. In yet another embodiment, the building insulation system further comprises a vapor permeable, fluid impermeable, film-based house wrap, wherein an 8 foot by 10 foot wall tested according to ASTM E283/E331 has an air filtration of less than 0.5 standard cubic foot per minute at a manometric pressure of 0.1 inches of water. In another embodiment with a vapor permeable fluid impermeable film-based house wrap, wherein the house wrap is taped at the seams, an 8 foot by 10 foot wall tested according to ASTM E283/E331 has an air filtration of less than 0.3 standard cubic foot per minute at a manometric pressure of 0.1 inches of water. In another embodiment, the non-foamed elastomeric polymer and the low density fiber insulation product are configured to provide a wall made therewith means for blocking sound traveling there through according to ASTM E90 to obtain a sound transmission class of greater than 34.

In illustrative embodiments, the non-foamed elastomeric polymer is configured to have a cross-sectional area of between 25 $mm^2$ and 50 $mm^2$ and a length of between about 10 m and 20 m per 32 $m^3$ of room. In one embodiment, the non-foamed elastomeric polymer is configured so that about 19 L fills and seals the gaps of a building having a volume of about 800 $m^3$. In another embodiment, the non-foamed elastomeric polymer is configured to be water-dispersable and water-dilutable prior to curing. In another embodiment, the non-foamed elastomeric polymer is adapted to be dissolvable with water prior to curing. In another embodiment, the non-foamed elastomeric polymer is configured to cure at standard temperature and pressure at 50% relative humidity in less than about 12 hours. In yet another embodiment, the non-foamed elastomeric polymer is configured to cure at standard temperature and pressure at 50% relative humidity in less than about 6 hours.

The invention will be further described in connection with the following examples, which are set forth for purposes of illustration only. The building insulation system is installed according to the following procedure. First, it should be pointed out that the elastomeric material should be protected from freezing. It can be applied from 0° to 110° F. as long as the elastomeric material is fluid in the bucket. It should be stored in a dry location with a temperature between 35° F. and 115° F. If the elastomeric material does freeze, make sure that it is completely thawed prior to use. The elastomeric material, prior to installation, is stable through at least five freeze-thaw cycles. In one aspect, the elastomeric material is safe to spray and dries quickly. It does not involve mixing hazardous chemicals at the jobsite nor does it generate hazardous off-gassing during cure. Accordingly, workers performing other tasks, (e.g. other tradesman) may stay on site. A building quarantine is not necessary. The elastomeric material cleans up with water, no chemical solvents are necessary. The elastomeric material should be installed after framing inspection. It should be done in conjunction with window/door sealing and installation of fire caulking, prior to insulating.

Representative equipment that workers will need to apply the elastomeric material of the present disclosure are a GRACO Ultra Max 795 Airless Sprayer with 50 feet of hose, a 6 foot whip hose, a spray gun, two nozzle extensions, a tip guard and one spray tip, a hose reel, and a digital tracking system. Those familiar with airless sprayers will appreciate the identity of these components and recognize them as standard equipment available for purchase at most paint supply stores. In addition, an adapter may be used to enable the sprayer to utilize two hoses. Furthermore, wrenches, bottle brushes, and water for clean up may be useful within the scope of the sealing process.

To apply the elastomeric material to a structure, such as a residential dwelling, the following steps may be followed to prepare for the application, although any one step may or may not be essential to the overall process: centrally locate the airless sprayer; check spray hose for proper length; arrange all necessary hand tools, equipment and accessory items (wrenches, brushes, drywall knife, paper towels, utility knife, etc.); bring in 2 five gallon pails of fresh water for cleanup; bring in an empty five gallon bucket for cleanout of nozzles and hose; connect required extensions/nozzles (a size 13 tip is recommended for most applications; colder temperatures may require changing to a larger size; try them sequentially [0.013", 0.015", 0.017" and 0.019"] until the desired bead is attained); connect to power source; lower intake of sprayer into a bucket containing the elastomeric material; flush machine and hose of water remaining in lines from previous cleanup; set PSI lever to ¾ of maximum pressure.

To apply the elastomeric material to a structure, such as a residential dwelling, the following steps may be followed, although any one step may or may not be essential to the overall process: place the wings of the tip guard directly (see FIG. 3) against the framing members with the nozzle opening pointing directly into the gap or seam to be filled with the wings of the tip guard parallel to the direction you will be moving; spray the elastomeric polymer into to all required vertical seams/joints in framing moving sequentially around each individual room; adjust air pressure level to lower or higher level depending on flow of material through nozzle; a small stream of product indicates not enough pressure; splattering of the material indicates that the pressure is too high; apply the elastomeric material to all required horizontal seams/joints in framing; apply the elastomeric material at the seam between the double plates at the top plate line; apply the elastomeric material at the junction between the bottom plate and the subfloor/slab (there are advantages in applying this last).

Furthermore, the following considerations may be taken: excess elastomeric material should be removed from the surface of the top plate, wall tee and all multiple studs using the rubber squeegee so as to not interfere with drywall; place the excess material in a small bucket so as to be dumped back into the main bucket or used for touchup; each room should be completed prior to moving to the next; wipe any unwanted uncured elastomeric material off with a damp rag prior to material drying. If installing the elastomeric material from the attic to all ceiling penetrations, drywall joints and junctions of drywall to the top plates, start from the outside edge of the attic area and work towards the center. An angled nozzle extension will make this application much easier. Segment the attic into sections and complete each section prior to moving to the next. Certain applications may require the angled nozzle extension in order to achieve the correct nozzle angle.

To clean up after the elastomeric material has been applied to a structure, such as a residential dwelling, the following steps may be followed, although any one step may or may not be essential to the overall process: remove any gobs of elastomeric material that may have been disposed in and allowed to cure in unintended places using a drywall knife. It is not necessary to clean the machine, hoses etc. between consecutive jobs on the same day. When the machine will not be used the next day, take the following steps for proper clean up. Cleanup is most easily accomplished at facility with a source of running water. Remove the bucket that held the elastomeric material from under the airless sprayer and replace with a bucket of clean water. Turn on sprayer and purge lines until all elastomeric material is evacuated and water flows freely. Turn off machine and bleed pressure from hose. Unscrew suction intake and remove the screw on filter from the bottom of the intake and clean. Thoroughly clean the outside and interior of the intake pipe being careful not to lose the 3 part (call bearing, flat disc and ball bearing holder) assembly that sits in the top portion of the intake. Additionally, do not lose the nylon washer that sits beneath the assembly. When cleaned thoroughly, reattach intake to the sprayer. Remove, clean and reinstall main sprayer filter. Clean the elastomeric material from the exterior surface of all nozzles, tips and extensions. Lower the clean intake into a bucket of clean water. Turn sprayer back on and flip the lever on the airless sprayer to the recirculation mode and flush the machine until clear. At least weekly, it may be appropriate to flush the lines and machine with mineral spirits. Clean residue from exterior surface of sprayer and hose as necessary.

Subsequent to allowing the elastomeric material to dry, the low density fiber insulation may be installed. Methods of installing the low density are not modified from those techniques well-known in the art. One aspect of the present disclosure is that these methods may be used unchanged while the result of the process is surprisingly enhanced.

Acoustical Testing

To determine the influence on the transmission of sound through a wall including the insulative sealing system described herein, the following analytical testing was performed. To rate performance, three metrics were used: Sound Transmission Class (STC), Average Sound Transmission Loss (TL) 160 Hz to 4000 Hz, and Outdoor Indoor Transmission Class (OITC). All walls had the same basic wall construction including: i) one layer of ½" thick gypsum, ii) 2"×4" wood studs 16" on center, iii) 7/16" thick 4'×8' oriented strand board, and iv) vinyl siding. The exterior walls included a controlled construction joint of ⅛" between the wall assembly and the floor assembly below and ceiling assembly above was systematically constructed.

Six (6) walls were tested: 1) R15 batt insulation (no sealant), 2) R15 batt insulation (no sealant) but interior pine molding applied over gaps, 3) R15 batt insulation and elastomeric material (no molding), 4) Blown in Batt (BIB) and elastomeric material (no molding), 5) a 2 pound cubic foot (pcf) foam with sealant (no molding), and 6) a ½ pcf foam with sealant (no molding). For testing, the walls were rolled between the test chamber, and the frame/camber interface was sealed. To make better use of laboratory time, the first frame was rolled between the chambers and the wall 1 was built in place. This framing was used for walls 2, 3, and 4. A spacer was used to generate the ⅛ inch gap at the bottom of the wall. A similar spacer was used at the top of the wall. Siding was installed over the building paper. The edges of the wall on both sides were sealed.

The two foam-insulated walls (5 and 6) were manufactured with standard commercially available spray-foam. The 2 pcf (Icynene) closed cell spray foam insulated wall was insulated by a local contractor. Note that the foam did not fill the cavity. In some areas excess foam was removed with a knife before gypsum was applied and taped. The gap at the top and bottom of the wall was sealed with an acoustical caulking used by the contractor for joint sealing. The frame was rolled between the test chambers and sealed, and the edges of the wall were also sealed. The ½ pcf (Icynene) open cell spray foam was insulated by a local contractor. Note that the foam filled the cavity. Excess foam was removed with a knife before gypsum was applied and taped. The gap at the top and bottom of the wall was sealed with an acoustical caulking used by the contractor for joint sealing. The frame was rolled between the test chambers and sealed, and the edges of the wall were also sealed. The wall was ready to test (6).

Table 1 provides a summary of the transmission loss and metric results. Note that the frequency range for the first two tests was 80 Hz to 5000 Hz, which is required for calculation of OITC. An extended range from 50 Hz to 10000 Hz was also measured. The STC or Sound Transmission Class of a partition is a single number rating based on laboratory sound transmission loss (TL) measurements. The sound transmission loss of a partition assembly measures the ability of the partition to block or attenuate the transmission of sound passing from one side to the other. The higher the sound transmission loss (measured in decibels, dB, from 125 Hz to 4000 Hz), the more a partition attenuates or reduces the transmission of sound passing through it. The single number STC rating is calculated from the TL data per ASTM E 413, "Classification for Rating Sound Insulation," the ASTM standard is hereby incorporated by reference in its entirety.

The STC is designed to provide a screening tool to quickly compare various construction assembly performances. Like many condensed rating numbers they have their benefits and their drawbacks. It is for this reason that three (3) different types of sound control ratings are presented to provide a broader and balanced perspective of product performance.

TABLE 1

Transmission loss and metric summary.
Transmission loss data

| Frequency, Hz | Wall 1 | Wall 2 | Wall 3 | Wall 4 | Wall 5 | Wall 6 |
|---|---|---|---|---|---|---|
| 50 | | | 24 | 24 | 25 | 24 |
| 63 | | | 19 | 20 | 20 | 19 |
| 80 | 16 | 18 | 19 | 19 | 21 | 21 |
| 100 | 13 | 14 | 16 | 15 | 19 | 19 |
| 125 | 12 | 13 | 13 | 15 | 20 | 19 |
| 160 | 19 | 19 | 17 | 14 | 18 | 16 |
| 200 | 28 | 28 | 27 | 22 | 17 | 16 |
| 250 | 29 | 32 | 34 | 31 | 17 | 21 |
| 315 | 29 | 30 | 30 | 32 | 21 | 29 |
| 400 | 30 | 32 | 32 | 32 | 24 | 29 |
| 500 | 30 | 32 | 34 | 34 | 26 | 30 |
| 630 | 31 | 33 | 35 | 37 | 27 | 32 |
| 800 | 31 | 35 | 39 | 41 | 31 | 35 |

TABLE 1-continued

Transmission loss and metric summary.
Transmission loss data

| Frequency, Hz | Wall 1 | Wall 2 | Wall 3 | Wall 4 | Wall 5 | Wall 6 |
|---|---|---|---|---|---|---|
| 1000 | 30 | 35 | 42 | 43 | 34 | 39 |
| 1250 | 27 | 35 | 43 | 44 | 37 | 41 |
| 1600 | 25 | 37 | 44 | 45 | 39 | 44 |
| 2000 | 26 | 37 | 44 | 45 | 39 | 44 |
| 2500 | 25 | 38 | 43 | 44 | 39 | 42 |
| 3150 | 25 | 40 | 43 | 44 | 39 | 41 |
| 4000 | 27 | 41 | 45 | 46 | 41 | 44 |
| 5000 | | | 48 | 49 | 44 | 46 |
| 6300 | | | 52 | 53 | 46 | 50 |
| 8000 | | | 56 | 58 | 49 | 54 |
| 10000 | | | 61 | 62 | 51 | 58 |
| Max deficiencies = | 6 | 6 | 8 | 8 | 6 | 8 |
| Sum deficiencies = | 31 | 32 | 28 | 18 | 28 | 32 |
| STC = | 27 | 35 | 37 | 35 | 30 | 34 |
| R = | 27 | 34 | 37 | 36 | 30 | 34 |
| OITC = | 23 | 25 | 25 | 25 | 24 | 25 |
| Ave TL 160 to 4k = | 27 | 34 | 37 | 37 | 30 | 34 |

Outdoor-Indoor Transmission Class (OITC) ratings were designed to compare building facade elements and structures exposed to transportation noise sources (primarily ground & air transportation). Acoustical measurements for this ASTM classification are based on what is termed A-weighted sound pressure levels, which is a weighted sound pressure measurement designed to reflect how the human ear responds to sound. Because transportation noise is designated as the targeted noise source, decibel measurements begin at a lower frequency level than STC and Average TL. OITC measurements begin at 80 Hz and span through 4000 Hz. Again OITC is a single number rating where the higher the rating, the greater the partition's ability to attenuate noise.

Air Infiltration Testing

Air infiltration testing was used to determine the effect of the elastomeric material disposed in accordance with the present disclosure on the ability of a normal stud wall with and without house-wrap to prevent the passage of air. The test was configured according to the following: The test wall measured 8' high by 10' long and was constructed in a conventional stick framing method using 2"×4" framing at 16" on center and with a single bottom plate and a double top plate. One interior electrical box was included, and wiring was run through each stud for the entire length of the wall at the height of the box. The wall was insulated with inset stapled R-13 Knauf EcoBatt kraft fiberglass batts. The interior side was covered with ½" drywall and the seams were taped with one coat of tape joint compound. For the test, the wall was sheathed with 4'×8' 7/16" OSB panels laid horizontally. The panels were gapped on all edges with a ⅛ inch gap per manufacturer's installation instructions. The sheathing was allowed to extend past the perimeter stud on each side and the top plate by approximately 2" in order to fasten the wall securely to the test chamber. Horizontal blocking was not installed. This resulted in one ⅛" horizontal gap running across the length of the test wall. The perimeter drywall joints to the studs and top plate were caulked to simulate the situation of a continuous wall that would extend beyond the extent of the test wall on the sides and a taped drywall seam between the wall and the ceiling at the top. The joint at the bottom plate was not caulked as typically there would not be a particularly air tight joint at the bottom plate/drywall interface. This test wall was used for each test, which consisted of different combinations of house wrap and the inclusion of the elastomeric material.

The air infiltration testing was conducted in the NAHB Research Center's ASTM E283/E331 chamber, these ASTM standards are hereby incorporated by reference herein in their entirety. The chamber measures approximately 8'-6" high by 10' long by 3' deep. The chamber is pressurized using a blower. The pressure differential is measured by inclined water manometers and the flow rate is measured through calibrated orifice plates. Air infiltration testing was conducted generally according to ASTM E283 "Standard Test Method for Determining Rate of Air Leakage Through Exterior Windows, Curtain Walls, and Doors Under Specific Pressure Differences Across the Specimen". In order to determine the system leakage, the wall was covered with a 6 mil poly film and the air infiltration rate was measured. Then, the poly film was cut away and the air infiltration rate was measured for the base wall. Air infiltration for each test configuration was measured with a 0.1" $H_2O$ (25 Pascals), 0.2" $H_2O$ (50 Pascals) and at 0.3" $H_2O$ (75 Pascals) pressure difference between the inside and outside of the test wall. The flow direction was from the exterior to the interior of the wall. After the base wall was tested at each of the three pressure differentials, house wrap was applied using 1" cap nails on 16" centers per the manufacturer's instructions. The house wrap was installed in two pieces with one vertical seam approximately in the middle of the wall. The air infiltration rate was re-tested to measure the effect of the house wrap. The vertical seam in the house wrap was then sealed with seam tape and the test was repeated. The drywall and insulation were then removed in order to apply the elastomeric material as described herein (the house wrap and seam tape remained in place). The elastomeric material was applied to four horizontal seams in the wall; seam between the two top plates, seam between OSB and top plate, horizontal seam in OSB and the seam between OSB and bottom plate. Both the drywall and insulation were again installed and the air infiltration rate was re-tested to measure the effect of the elastomeric material. After the wall was tested at each of the three pressure differentials, the seam tape was removed from the house wrap and the test was repeated. The house wrap was then removed and the wall re-tested. The data from this testing can be seen in Table 2.

TABLE 2

Air Infiltration Test Data.

| | At 0.1" $H_2O$ | | | At 0.2" $H_2O$ | | | At 0.3" $H_2O$ | | |
|---|---|---|---|---|---|---|---|---|---|
| Test Wall | Base Wall | Horizontal Seams Sealed | Picture Frame Seal | Base Wall | Horizontal Seams Sealed | Picture Frame Seal | Base Wall | Horizontal Seams Sealed | Picture Frame Seal |
| Base Wall | 5.88 | 2.90 | 0.65 | 9.73 | 5.17 | 1.20 | 13.3 | 6.89 | 1.78 |
| With House Wrap | 1.19 | 1.42 | 0.41 | 1.73 | 2.17 | 0.60 | 2.12 | 2.49 | 0.91 |
| With House Wrap Taped | 0.78 | 0.61 | 0.21 | 1.22 | 0.85 | 0.18 | 1.53 | 1.21 | 0.25 |

As shown in Table 2, the application of the elastomeric material (designated as Sealed in the Table) significantly reduced the air infiltration through the test wall. When the wall was "picture frame" sealed, the air infiltration rate was reduced to approximately the same as the unsealed wall with the house wrap with the seam taped. When picture frame sealing was combined with house wrap with a taped seam the air infiltration was reduced to 98% of the unsealed base wall case.

Surface Burning Characteristics

The surface burning characteristics of the elastomeric material was tested in accordance with Standard ANSI/UL723, Tenth Edition, dated Sep. 10, 2008, "Test for Surface Burning Characteristics of Building Materials", (ASTM E84-10). This ASTM standard is hereby incorporated by reference in its entirety. The test determines the Surface Burning Characteristics of the material, specifically the flame spread and smoke developed indices when exposed to fire. The maximum distance the flame travels along the length of the sample from the end of the igniting flame is determined by observation. The Flame Spread Index of the material is derived by plotting the progression of the flame front on a time-distance basis, ignoring any flame front recession, and using the following equations: A. CFS=0.515 AT when AT is less than or equal to 97.5 minute-foot; B. CFS=4900/(195-AT) when AT is greater than 97.5 minute-foot (where AT=total area under the time distance curve expressed in minute-foot). The Smoke Developed Index (SDI) is determined by rounding the Calculated Smoke Developed (CSD) as described in UL 723, the standard is hereby incorporated by reference in its entirety. The CSD is determined by the output of photoelectric equipment operating across the furnace flue pipe. A curve is developed by plotting the values of light absorption (decrease in cell output) against time. The CSD is derived by expressing the net area under the curve for the material tested as a percentage of the area under the curve for untreated red oak. The CSD is expressed as: CSD=(Am/Aro)×100 Eco properties (VOC, toxicity, renewable/recycled content); where: CSD=Calculated Smoke Developed; Am=The area under the curve for the test material; Aro=The area under the curve for untreated red oak. The samples tested include two 0.2 inch cured spherical samples spaced 8 inches apart on a cement fiber-board. The results can be seen in Table 3.

TABLE 3

Surface Burning Characteristics

| TEST | Result |
|---|---|
| CFS Calculated Flame Spread | 0.00 |
| FSI Flame Spread Index | 0 |
| CSD Calculated Smoke Developed | 0.0 |
| SDI Smoke Developed Index | 0 |

Elastomeric Material Performance

Performance of the elastomeric material was tested according to ASTM D412-06a Method A, which is hereby incorporated by reference in its entirety. The test method was used to evaluate tensile (tension) and elongation properties of the elastomeric material. Three embodiments of the elastomeric material were tested, Examples A, B, and C.

The samples were prepared and cured using an accelerated curing method: 4 days at RT (room temperature), 4 days 60° C. The samples were cooled to 73° F. before testing. The rate of grip separation was set to 50+/−5 mm/min (2+/−0.2 in/min). The observed results are shown in Table 4.

TABLE 4

Elastomeric Material Properties

| Sample | Avg. Thickness (mm) | Stress @ 25% Elongation (psi) | Stress @ 50% Elongation (psi) | Stress @ 100% Elongation (psi) | Stress @ Break (psi) | Max Stress (psi) | % Elongation @ Max Stress | % Elongation @ Break |
|---|---|---|---|---|---|---|---|---|
| Ex-A | 1.73 | 34.2 | 38.8 | 42.8 | 26.9 | 69.5 | 415.7 | 935.3 |
| Ex-B | 1.69 | 254.6 | 254.6 | 251.3 | 210.2 | 257.5 | 72.4 | 154.4 |
| Ex-C | 1.68 | 105.0 | 100.5 | 91.6 | 34 | 107.7 | 42.1 | 119.7 |

Performance of the elastomeric material was tested according to ASTM D2202-00 Standard Test Method for Slump of Sealants, which is hereby incorporated by reference in its entirety. The test provided a means for evaluating the degree of slump when used in a vertical joint in a structure. The samples were prepared in a horizontal position by filling the cleaned cavity of a Frazier Boeing Jig flush, avoiding any air entrapment, standing the jig upright and advancing the plunger to one half its maximum travel, 3/16" thick, placing the jig immediately in an oven set at 50+/−2° C., standing vertically upright for 30 minutes. The results are shown in Table 5.

TABLE 5

Slump testing.

| Sample | 23° C. 3/8" depth, 1.5" diameter cavity (w/out spacer) | 23° C. 3/16" depth, 1.5" diameter cavity (w/spacer) | 50° C. 3/8" depth, 1.5" diameter cavity (w/out spacer) | 50° C. 3/16" depth, 1.5" diameter cavity (w/spacer) |
|---|---|---|---|---|
| Ex-B | 0.03 inch | 0.00 inch | 0.05 inch | 0.00 inch |
| Ex-C | 0.16 inch | 0.01 inch | 0.00 inch | 0.08 inch |

To further characterize the samples, physical characterization data was collected according to the ordinary methods. Some of these results are shown in Table 6. ASTM C 1183-04, which is hereby incorporated by reference in its entirety, is used to evaluate the extrusion rate. ASTM C 719-93 (Reapproved 2005), which is hereby incorporated by reference in its entirety, is used to test adhesion and cohesion under cyclic movement (Hockman Cycle). ASTM C 734-01, which is hereby incorporated by reference in its entirety, is used to determine the low-temperature flexibility after artificial weathering. ASTM C 794-01, which is hereby incorporated by reference in its entirety, is used to test adhesion-in-peel.

TABLE 6

Representative Characterization.

| Sample | Sample pH | pH Range | Sample Viscosity @ 23 +/− 3° C. | Viscosity Range @ 23 +/− 32 ° C. | Sample % Solids | % Solids Range | Sample Specific Gravity (g · cm$^2$) | Specific Gravity Range (g · cm$^2$) |
|---|---|---|---|---|---|---|---|---|
| Ex-B | 8.8 | 8.0-9.5 | 236K | 200K-375K | 65.71 | 63-66 | 1.34 | 1.24-1.34 |
| Ex-C | 8.3 | 8.0-9.5 | 304K | 200K-375K | 64.26 | 63-66 | 1.35 | 1.24-1.34 |

Environmental Indoor Air Quality Testing

The elastomeric material was tested to determine the impact of the elastomeric material on indoor air quality (IAQ). The elastomeric material was tested using a GREENGUARD product evaluation test protocol (1) following the requirements of The GREENGUARD Environmental Institute's (GEI) Product Certification Program, ASTM Standard D 5116, and the United States Environmental Protection Agency (USEPA) (2-4), both of which are hereby incorporated by reference in their entirety. Testing of the product was conducted using standard environmental chamber operating conditions. The elastomeric material was monitored for emissions of total volatile organic compounds (TVOCs), formaldehyde, total aldehydes, and other individual volatile organic compounds (IVOCs) over a 168 hour exposure period. These emissions were measured and the resultant air concentrations were determined for each of the potential pollutants. Air concentration predictions were computer modeled based on the GEI Requirements, which include a standard room loading and ASHRAE Standard 62.1-2007 ventilation conditions, which standard is hereby incorporated by reference in its entirety. Product loading is based on a standard sealant usage (14.6 m in total length) in a 32 m3 room. Results were compared to current emission levels as required by the GREENGUARD standard. Emissions data and expected air concentrations are shown in Table 7.

TABLE 7

Indoor Air Quality Testing.

| | Acceptable IAQ Criteria | Product Measurment | Complaint for IAQ |
|---|---|---|---|
| TVOC | 0.5 mg/m3 | 0.005 mg/m3 | Yes |
| Formaldehyde | 0.05 ppm | <0.001 ppm | Yes |
| 4-Phenylcyclohexene | 0.0065 mg/m3 | <0.001 mg/m3 | Yes |
| Total Aldehydes | 0.1 ppm | <0.001 mg/m3 | Yes |
| Individual VOC's | all < 1/10 TLV | — | Yes |

Embodiments of the invention are further described by the following enumerated clauses.

1. A building insulation system comprising an elastomeric polymer and a low density fiber insulation product, wherein the elastomeric polymer is adapted to contact a building to fill and seal gaps, the gaps formed at a location between two or more structural members of a wall, the elastomeric polymer configured to provide means for blocking movement of air through the wall so that air infiltration is diminished by at least about 96% to maximize energy efficiency of the structure, total volatile organic emissions released during curing is minimized, and ASTM E84 flame resistance is better than 25/75.

2. The building insulation system of clause 1 wherein the elastomeric polymer is configured to have a cross-sectional profile featuring a central ridge having a depth of between about 2 mm and 15 mm.

2b. The building insulation system of clause 1 wherein the elastomeric polymer is configured to have a cross-sectional profile having an area of between about 16 mm$^2$ and 169 mm$^2$.

2c. The building insulation system of clause 1 wherein the elastomeric polymer is configured to have a cross-sectional profile having an area of between about 36 mm$^2$ and 144 mm$^2$.

2d. The building insulation system of clause 1 wherein the elastomeric polymer is configured to have a cross-sectional profile having an area of between about 36 mm$^2$ and 100 mm$^2$.

3. The building insulation system any of clauses 2-2d, wherein the cross-sectional profile includes a tail region that extends onto the two or more structural members according to a diminishing pattern.

4. The building insulation system of clause 3, wherein the cross-sectional profile results in a concave surface facing away from the two or more structural members.

5. The building insulation system of clause 3, wherein the diminishing pattern extends onto one of the two or more structural members for a distance of between 5 mm and about 80 mm.

5b. The building insulation system of clause 3, wherein the diminishing pattern extends onto one of the two or more structural members for a distance of between 5 mm and about 45 mm.

6. The building insulation system of clause 2, wherein the cross-sectional profile includes an extension that at least partially fills the gap between the two or more structural members.

7. The building insulation system of any of clauses 1-6, wherein the elastomeric polymer comprises by weight about 10% to about 60% of an carboxylic acid containing polymer, about 16% to about 60% of one or more inorganic fillers, and less than about 5% flame retardant.

8. The building insulation system of clause 7, wherein the elastomeric polymer comprises by weight about 10% to about 40% of an acrylic resin,
about 20% and 45% water, and
about 10% to about 30% calcium carbonate,
about 5% to about 10% Kaolin clay
about 1% to about 5% titanium dioxide, and
less than about 3% flame retardant.

8b. The building insulation system of clause 7, wherein the elastomeric polymer comprises a dipropylene glycol dibenzoate, a polyvinyl acetate emulsion, and a polymerized rosin.

9. The building insulation system of any of clauses 7-8b, wherein the elastomeric polymer has a pH of between about 7.2 and about 10.3.

9b. The building insulation system of any of clauses 7-8b, wherein the elastomeric polymer has a pH of between about 8.4 and about 9.6.

10. The building insulation system of any of clauses 7-9b, wherein total volatile organic emissions released during curing is less than about 0.5 mg/m$^3$.

10b. The building insulation system of any of clauses 7-9b, wherein total volatile organic emissions released during curing is less than about 0.1 mg/m$^3$.

10c. The building insulation system of any of clauses 7-9b, wherein total volatile organic emissions released during curing is between about 0.001 than about 0.01 mg/m$^3$.

11. The building insulation system of any of clauses 7-10c, wherein the elastomeric polymer has a cured density of between about 0.8 and about 1.8 g/mL.

11b. The building insulation system of any of clauses 7-10c, wherein the elastomeric polymer has a cured density of between about 1 and about 1.6 g/mL.

11c. The building insulation system of any of clauses 7-10c, wherein the elastomeric polymer has a cured density of between about 1 and about 1.3 g/mL.

12. The building insulation system of any of clauses 7-11c, wherein the low density fiber insulation product is a mineral fiber insulation product.

13. The building insulation system of any of clauses 7-11c, wherein the low density fiber insulation product is a fiberglass insulation product.

13b. The building insulation system of any of clauses 7-11c, wherein the low density fiber insulation product is a batt of fiberglass insulation.

13c. The building insulation system of any of clauses 7-11c, wherein the low density fiber insulation product is a loose fill or blown fiberglass insulation.

14. The building insulation system of any of clauses 7-11c, wherein the low density fiber insulation product is a cellulosic loose fill or blown insulation product.

15. The building insulation system of any of clauses 1-14, wherein the low density fiber insulation product has a density from about 0.4 lbs/ft$^3$ to about 6 lbs/ft$^3$.

15b. The building insulation system of any of clauses 1-14, wherein the low density fiber insulation product has a density from about 0.4 lbs/ft$^3$ to about 1.5 lbs/ft$^3$.

15c. The building insulation system of any of clauses 1-14, wherein the low density fiber insulation product has a density from about 0.75 lbs/ft$^3$ to about 2.5 lbs/ft$^3$.

15d. The building insulation system of any of clauses 1-14, wherein the low density fiber insulation product has a density from about 2.25 lbs/ft$^3$ to about 4.25 lbs/ft$^3$.

15e. The building insulation system of any of clauses 1-14, wherein the low density fiber insulation product has a density from about 3.75 lbs/ft$^3$ to about 5.2 lbs/ft$^3$.

16. The building insulation system of any of clauses 1-15e, wherein the low density fiber insulation product has a R-value of from about 11 to about 60.

16b. The building insulation system of any of clauses 1-15e, wherein the low density fiber insulation product has a R-value of from about 2 to about 8.

16c. The building insulation system of any of clauses 1-15e, wherein the low density fiber insulation product has a R-value of from about 3.4 to about 10.2.

16d. The building insulation system of any of clauses 1-15e, wherein the low density fiber insulation product has a R-value of from about 8 to about 38.

17. The building insulation system of any of clauses 1-16d, wherein the low density fiber insulation product has a noise reduction coefficient of from about 0.5 to about 1.10.

17b. The building insulation system of any of clauses 1-16d, wherein the low density fiber insulation product has a noise reduction coefficient of from about 0.6 to about 0.70.

17c. The building insulation system of any of clauses 1-16d, wherein the low density fiber insulation product has a noise reduction coefficient of from about 0.7 to about 1.00.

17d. The building insulation system of any of clauses 1-16d, wherein the low density fiber insulation product has a noise reduction coefficient of from about 0.95 to about 1.15.

18. A building insulation system comprising a non-foamed elastomeric polymer and a low density fiber insulation product, wherein the elastomeric polymer is adapted to contact a building to fill and seal gaps, the gaps formed at a location between two or more structural members of a wall.

19. The building insulation system of clause 18, wherein the elastomeric polymer is configured with to have a time of ignition of greater than 60 seconds as determined according to UL 723.

19b. The building insulation system of clause 18, wherein the elastomeric polymer is configured with to have a time of ignition of between about 60 seconds and 360 seconds as determined according to UL 723.

19c. The building insulation system of clause 18, wherein the elastomeric polymer is configured with to have a time of ignition of between about 70 seconds and 140 seconds as determined according to UL 723.

20. The building insulation system of any of clauses 18-19c, wherein an 8 foot by 10 foot wall tested according to ASTM E283/E331 has an air filtration of less than 1 standard cubic foot per minute at a manometric pressure of 0.1 inches of water.

20b. The building insulation system of any of clauses 18-19c, wherein an 8 foot by 10 foot wall tested according to ASTM E283/E331 has an air filtration of less than 1.5 standard cubic foot per minute at a manometric pressure of 0.2 inches of water.

20c. The building insulation system of any of clauses 18-19c, wherein an 8 foot by 10 foot wall tested according to ASTM E283/E331 has an air filtration of less than 2 standard cubic foot per minute at a manometric pressure of 0.3 inches of water.

21. The building insulation system of clause 18, further comprising a vapor permeable fluid impermeable film-based house wrap wherein an 8 foot by 10 foot wall tested according to ASTM E283/E331 has an air filtration of less than 0.5 standard cubic foot per minute at a manometric pressure of 0.1 inches of water.

21b. The building insulation system of clause 18, further comprising a vapor permeable fluid impermeable film-based house wrap, the house wrap being tape at seams wherein an 8 foot by 10 foot wall tested according to ASTM E283/E331 has an air filtration of less than 0.3 standard cubic foot per minute at a manometric pressure of 0.1 inches of water.

22. The building insulation system of any of clauses 18-21b, wherein the non-foamed elastomeric polymer and the low density fiber insulation product are configured to provide a wall made therewith means for blocking sound traveling there through according to ASTM E90 to obtain a sound transmission class of greater than 34.

23. The building insulation system of any of clauses 18-22, wherein the non-foamed elastomeric polymer is configured to have a cross-sectional area of between 25 mm$^2$ and 50 mm$^2$ and a length of between about 10 m and 20 m per 32 m$^3$ of room.

24. The building insulation system of any of clauses 18-23, wherein the non-foamed elastomeric polymer is configured so that about 19 L fills and seals the gaps of a building having a volume of about 800 m$^3$.

25. The building insulation system of any of clauses 18-24, wherein the non-foamed elastomeric polymer is configured to be water-dispersable and water-dilutable prior to curing.

26. The building insulation system of any of clauses 18-25, wherein the non-foamed elastomeric polymer is adapted to be dissolvable with water prior to curing.

27. The building insulation system of any of clauses 18-26, wherein the non-foamed elastomeric polymer is configured to cure at standard temperature and pressure at 50% relative humidity in less than about 12 hours.

27b. The building insulation system of any of clauses 18-26, wherein the non-foamed elastomeric polymer is configured to cure at standard temperature and pressure at 50% relative humidity in less than about 6 hours.

28. A method for insulating a wall comprising:

spraying a non-foaming elastomeric material onto gaps formed at a location between two or more structural members of a wall, the two or more structural members defining a wall cavity, waiting for an amount of time sufficient for the elastomeric material to cure, and installing a fiber insulation product into the wall cavity.

29. The method of clause 28, wherein spraying includes pumping the elastomeric material from a single container to a dispensing gun.

30. The method of clause 28 or 29, wherein spraying includes using an airless sprayer at an operating pressure of greater than about 100 psi.

30b. The method of clause 28 or 29, wherein spraying includes using an airless sprayer at an operating pressure of between about 500 and about 4000 psi.

30c. The method of clause 28 or 29, wherein spraying includes using an airless sprayer at an operating pressure of between about 1500 and about 3000 psi.

31. The method of any of clauses 28-30c, wherein spraying includes using a gun having a distance control mechanism and a nozzle for spraying the elastomeric material, the distance control mechanism maintaining a distance between the nozzle and the one or more structural members.

32. The method of clause 32, wherein spraying includes contacting the distance control mechanism with the one or more structural member and moving the gun across the structural member so that the distance between the structural member and the nozzle remains substantially uniform.

33. The method of clause 32, wherein spraying includes dispensing an amount of elastomeric material at a predetermined rate and moving the gun across the structural member includes moving with a substantially constant speed so that the amount of elastomeric resin dispensed onto the gap remains substantially uniform across the structural member.

34. The method of any of clauses 28-33, wherein spraying includes forming a bead having a cross-sectional profile comprising a central maxima with diminishing edges.

35. The method of any of clauses 28-34, wherein spraying includes projecting the elastomeric material with sufficient pressure so that the elastomeric material at least partially fills the gap between the structural members.

36. The method of clause 33, wherein the substantially constant speed is in the range of about 0.3 to about 2 feet per second.

The invention claimed is:

1. A building insulation system comprising an elastomeric polymer and a fiber insulation product, wherein the elastomeric polymer is adapted to contact a building to fill and seal gaps, the gaps formed at a location between two or more structural members of a wall, the two or more structural members of the wall defining a wall cavity and the fiber insulation product being installed in the wall cavity, the elastomeric polymer is configured to provide means for blocking movement of air through the wall so that air infiltration is diminished by at least about 96% to maximize energy efficiency of the structure, total volatile organic emissions released during curing is minimized, and ASTM E84 flame resistance is better than 25/75.

2. The building insulation system of claim 1 wherein the elastomeric polymer is configured to have a cross-sectional profile featuring a central ridge having a depth of between about 2 mm and 15 mm.

3. The building insulation system of claim 2, wherein the cross-sectional profile includes a tail region that extends onto the two or more structural members according to a diminishing pattern.

4. The building insulation system of claim 3, wherein the cross-sectional profile results in a concave surface facing away from the two or more structural members.

5. The building insulation system of claim 3, wherein the diminishing pattern extends onto one of the two or more structural members for a distance of one or more of:

(a) between 5 mm and about 80 mm; and (b) between 5 mm and about 45 mm.

6. The building insulation system of claim 2, wherein the cross-sectional profile includes an extension that at least partially fills the gap between the two or more structural members.

7. The building insulation system of claim 1 wherein the elastomeric polymer is configured to have a cross-sectional profile having an area of one or more of:

(a) between about 16 $mm^2$ and 169 $mm^2$;

(b) between about 36 $mm^2$ and 144 $mm^2$; and (c) between about 36 $mm^2$ and 100 $mm^2$.

8. The building insulation system of claim 1, wherein the elastomeric polymer comprises by weight about 10% to about 60% of an carboxylic acid containing polymer, about 16% to about 60% of one or more inorganic fillers, and less than about 5% flame retardant.

9. The building insulation system of claim 8, wherein the elastomeric polymer comprises by weight about 10% to about 40% of an acrylic resin, about 20% and 45% water, and about 10% to about 30% calcium carbonate, about 5% to about 10% Kaolin clay about 1% to about 5% titanium dioxide, and less than about 3% flame retardant.

10. The building insulation system of claim 8, wherein the elastomeric polymer comprises a dipropylene glycol dibenzoate, a polyvinyl acetate emulsion, and a polymerized rosin.

11. The building insulation system of claim 8, wherein the elastomeric polymer has a pH of one or more of:

(a) between about 7.2 and about 10.3; and (b) between about 8.4 and about 9.6.

12. The building insulation system of claim 8, wherein total volatile organic emissions released during curing is one or more of:

(a) less than about 0.5 $mg/m^3$;

(b) less than about 0.1 $mg/m^3$; and (c) between about 0.001 than about 0.01 $mg/m^3$.

13. The building insulation system of claim 8, wherein the elastomeric polymer has a cured density of one or more of:

(a) between about 0.8 and about 1.8 g/mL;

(b) between about 1 and about 1.6 g/mL; and (c) between about 1 and about 1.3 g/mL.

14. The building insulation system of claim 1, wherein the fiber insulation product is one or more of:

(a) a mineral fiber insulation product;

(b) a fiberglass insulation product;

(c) a batt of fiberglass insulation;

(d) a loose fill or blown fiberglass insulation; and (e) a cellulosic loose fill or blown insulation product.

15. The building insulation system of claim 1, wherein the fiber insulation product has a density of one or more of:

(a) from about 0.4 lbs/ft$^3$ to about 6 lbs/ft$^3$;

(b) from about 0.4 lbs/ft$^3$ to about 1.5 lbs/ft$^3$;

(c) from about 0.75 lbs/ft$^3$ to about 2.5 lbs/ft$^3$;

(d) from about 2.25 lbs/ft$^3$ to about 4.25 lbs/ft$^3$; and (e) from about 3.75 lbs/ft$^3$ to about 5.2 lbs/ft$^3$.

16. The building insulation system of claim 1, wherein the fiber insulation product has a R-value of one or more of:

(a) from about 11 to about 60;

(b) from about 2 to about 8;

(c) from about 3.4 to about 10.2; and (d) from about 8 to about 38.

17. The building insulation system of claim 1, wherein the fiber insulation product has a noise reduction coefficient of one or more of:

(a) from about 0.5 to about 1.10;

(b) from about 0.6 to about 0.70;

(c) from about 0.7 to about 1.00; and (d) from about 0.95 to about 1.15.

18. A building insulation system comprising a non-foamed elastomeric polymer and a fiber insulation product, wherein the elastomeric polymer is adapted to contact a building to fill and seal gaps, the gaps formed at a location between two or more structural members of a wall, the two or more structural members of the wall defining a wall cavity and the fiber insulation product being installed in the wall cavity.

19. The building insulation system of claim 18, wherein the elastomeric polymer is configured to have a time of ignition of one or more of:

(a) greater than 60 seconds as determined according to UL 723; or (b) between about 60 seconds and 360 seconds as determined according to UL 723; or (c) between about 70 seconds and 140 seconds as determined according to UL 723.

20. The building insulation system of claim 18, wherein an 8 foot by 10 foot wall tested according to ASTM E283/E331 has an air filtration of one or more of:

(a) less than 1 standard cubic foot per minute at a manometric pressure of 0.1 inches of water;

(b) less than 1.5 standard cubic foot per minute at a manometric pressure of 0.2 inches of water; and (c) less than 2 standard cubic foot per minute at a manometric pressure of 0.3 inches of water.

21. The building insulation system of claim 18, further comprising one or more of:

(a) a vapor permeable fluid impermeable film-based house wrap wherein an 8 foot by 10 foot wall tested according to ASTM E283/E331 has an air filtration of less than 0.5 standard cubic foot per minute at a manometric pressure of 0.1 inches of water; and (b) a vapor permeable fluid impermeable film-based house wrap, the house wrap being tape at seams wherein an 8 foot by 10 foot wall tested according to ASTM E283/E331 has an air filtration of less than 0.3 standard cubic foot per minute at a manometric pressure of 0.1 inches of water.

22. The building insulation system of claim 18, wherein the non-foamed elastomeric polymer and the fiber insulation product are configured to provide a wall made therewith means for blocking sound traveling there through according to ASTM E90 to obtain a sound transmission class of greater than 34.

23. The building insulation system of claim 18, wherein the non-foamed elastomeric polymer is configured to have a cross-sectional area of between 25 mm$^2$ and 50 mm$^2$ and a length of between about 10 m and 20 m per 32 m$^3$ of room.

24. The building insulation system of claim 18, wherein the non-foamed elastomeric polymer is configured so that about 19 L fills and seals the gaps of a building having a volume of about 800 m$^3$.

25. The building insulation system of claim 18, wherein the non-foamed elastomeric polymer is configured to be water-dispersable and water-dilutable prior to curing.

26. The building insulation system of claim 18, wherein the non-foamed elastomeric polymer is adapted to be dissolvable with water prior to curing.

27. The building insulation system of claim 18, wherein the non-foamed elastomeric polymer is configured to cure at standard temperature and pressure at 50% relative humidity in less than about 12 hours.

28. The building insulation system of claim 18, wherein the non-foamed elastomeric polymer is configured to cure at standard temperature and pressure at 50% relative humidity in less than about 6 hours.

29. A method for insulating a wall comprising:

spraying a non-foaming elastomeric material onto gaps formed at a location between two or more structural members of a wall, the two or more structural members defining a wall cavity, waiting for an amount of time sufficient for the elastomeric material to cure, and installing a fiber insulation product into the wall cavity.

30. The method of claim 29, wherein spraying includes pumping the elastomeric material from a single container to a dispensing gun.

31. The method of claim 30, wherein spraying includes using an airless sprayer at an operating pressure of one or more of:

(a) greater than about 100 psi;

(b) between about 500 and about 4000 psi; and (c) between about 1500 and about 3000 psi.

32. The method of claim 30, wherein spraying includes using a gun having a distance control mechanism and a nozzle for spraying the elastomeric material, the distance control mechanism maintaining a distance between the nozzle and the one or more structural members.

33. The method of claim 32, wherein spraying includes contacting the distance control mechanism with the one or more structural member and moving the gun across the structural member so that the distance between the structural member and the nozzle remains substantially uniform.

34. The method of claim 33, wherein spraying includes dispensing an amount of elastomeric material at a predetermined rate and moving the gun across the structural member includes moving with a substantially constant speed so that the amount of elastomeric resin dispensed onto the gap remains substantially uniform across the structural member.

35. The method of claim 34, wherein the substantially constant speed is in the range of about 0.3 to about 2 feet per second.

36. The method of claim 29, wherein spraying includes forming a bead having a cross-sectional profile comprising a central maxima with diminishing edges.

37. The method of claim 29, wherein spraying includes projecting the elastomeric material with sufficient pressure so that the elastomeric material at least partially fills the gap between the structural members.

* * * * *